US005762284A

United States Patent [19]

Rautiainen et al.

[11] Patent Number: 5,762,284

[45] Date of Patent: Jun. 9, 1998

[54] ASSEMBLY FOR THE UNWINDER END OF AN OFF-MACHINE PAPER WEB HANDLING LINE

[75] Inventors: Pentti Rautiainen; Stig Renvall, both of Järvenpää , Finland; Chris Bertram, Kawerau, New Zealand

[73] Assignee: Valmet Corporation, Helsinki, Finland

[21] Appl. No.: 636,910

[22] Filed: Apr. 22, 1996

Related U.S. Application Data

[63] Continuation of Ser. No. 199,836, Feb. 22, 1994, abandoned.

[30] Foreign Application Priority Data

Feb. 19, 1993 [FI] Finland ..... 930765

[51] Int. Cl.[6] ..... B65H 19/18

[52] U.S. Cl. ..... 242/555.3; 34/117

[58] Field of Search ..... 34/114, 117, 120; 242/555.3, 564.3, 564.4, 525.3

[56] References Cited

U.S. PATENT DOCUMENTS

| | | | |
|---|---|---|---|
| 2,387,386 | 10/1945 | Cohn | 242/525.3 |
| 2,934,338 | 4/1960 | Labine | 242/564.4 X |
| 3,189,293 | 6/1965 | Prager | 242/555.3 |
| 3,194,508 | 7/1965 | Netze | 242/555.3 |
| 3,679,524 | 7/1972 | Bassett et al. | 242/555.3 X |
| 3,871,290 | 3/1975 | Verboom | 242/525.3 X |
| 4,000,035 | 12/1976 | Schiel et al. | 34/117 X |
| 4,485,567 | 12/1984 | Ely | 34/114 X |
| 4,540,131 | 9/1985 | Ishii et al. | 242/564.3 X |
| 4,918,836 | 4/1990 | Wedel | 34/114 X |
| 5,062,216 | 11/1991 | Hannigan | 34/120 X |
| 5,101,701 | 4/1992 | Boldrini et al. | 242/564.4 X |
| 5,129,294 | 7/1992 | Boldrini et al. | 242/564.4 X |
| 5,144,758 | 9/1992 | Skaugen et al. | 34/114 X |
| 5,185,063 | 2/1993 | Aula et al. | 34/117 X |
| 5,248,390 | 9/1993 | Fissmann et al. | 34/117 X |
| 5,253,819 | 10/1993 | Butler, Jr. | 242/555.3 X |
| 5,311,672 | 5/1994 | Kotitschke et al. | 34/117 |

FOREIGN PATENT DOCUMENTS

| | | | |
|---|---|---|---|
| 8 125 551 | 7/1983 | Japan | 242/555.3 |

*Primary Examiner*—Daniel P. Stodola
*Assistant Examiner*—William A. Rivera
*Attorney, Agent, or Firm*—Cohen, Pontani, Lieberman, Pavane

[57] ABSTRACT

When a new roll is changed in an off-machine coating line into the unwinder, problems are encountered in matching the tension of the web received from the expiring roll to that to be paid off from the new roll. Differences in web tension cause web breaks during roll change. To avoid this, the web is supported at the unwinder, and subsequently, at the following dryer cylinder group by a support felt that equalizes differences in web tension. The web received from the first roll is spliced to the tail of a second, full roll by pressing the web received from the first roll against the web of the second roll via the support felt by a splicing roll. Next, the web is fed supported by the felt to a dryer cylinder group including VAC and steam cylinders where the damp web is dried for subsequent coating.

10 Claims, 3 Drawing Sheets

ASSEMBLY FOR THE UNWINDER END OF AN OFF-MACHINE PAPER WEB HANDLING LINE

This is a continuation of application Ser. No. 08/199,836, filed Feb. 22, 1994, now abandoned.

BACKGROUND OF THE INVENTION

1. Field of the Invention

The present invention relates to an assembly for use in an off-machine coating line or other paper web finishing line in the handling of a paper web from an unwinder and the routing of the web to a coating machine.

2. Description of the Prior Art

The paper web manufactured in a paper machine is finished either using on-machine equipment directly following the paper machine, whereby the base sheet coming out of the paper machine is coated and finished with equipment having a width and speed compatible with those of the paper machine, or alternatively, using off-machine equipment, whereby the output of a single paper machine can be handled by a plurality of finishing equipment pieces. The major benefits of on-machine systems are their high productivity and the possibility of attaining a finished product in a single process. In off-machine equipment the properties of the finished product can be varied in a more flexible manner and often they can give higher quality.

The configuration of an off-machine coating can be widely varied and such equipment is always tailored to customer specifications. Thus, a coating line can include, e.g., an unwinder, several coater stations, dryers and a calendar. The last unit in the line is a rewinder.

Paper web handling in off-machine equipment occurs in the following manner. Base web rolls manufactured in a paper machine are transferred to the finishing line and are lifted onto the unwinding stands to wait for their turn for finishing. After the preceding roll is finished, a new base web roll can be transferred onto the unwinding stand. A roll is changed by stopping the line, then feeding the web tail of the new roll through the line at low speed, and finally accelerating the web to the normal running speed. Because the changing of the roll in this manner is slow, the current practice is to aim at roll changes without stopping the equipment. To accomplish this, the diameter of the roll being unwound is allowed to become sufficiently small, then the web speed is reduced by a suitable amount. The roll being finished is lifted from the primary unwinding stand to a secondary unwinding stand, and a new roll is transferred to the primary unwinding stand. A two-sided adhesive tape or a similar tacky splicing means is attached to the web tail of the new roll and the tangential speed of the new roll is accelerated equal to the actual web speed, whether normal or reduced. The perimeter of the new roll. is pressed against the perimeter of the preceding roll, whereby the splicing tape adheres to the running web and the web tail of the new roll is fed with the running web through the entire line. Subsequently, the web of the first, finished roll is cut and the speed of the finishing line is accelerated to normal, unless otherwise desired.

From the unwinder the web passes to a first coater, to the dryers, to the second coater station, and then further alternately to dryers and coaters, depending on how many coater stations are included in the line and how many coats are being applied to the end product. Subsequent to coating, the web can be calendered in a calender included in the line, or alternatively, in a separate calender. At the end of the finishing line the web is again wound into a roll by means of a rewinder.

One of the problems in off-machine finishing lines of the above-described type is the roll change. Though the roll change can be made, e.g., in the above manner without stopping the line, web breaks are common during the roll change. The principal cause of web breaks is related to the difference in web tension between the running web of the unwound roll and the web of the new roll. To avoid web breaks, the roll change is made using a temporarily reduced web speed. When a web break occurs, the web tail must be guided through the entire line at a reduced threading speed. However, web threading causes a production interruption during which broke will be produced, particularly if web threading is not successful the first try. If the web is dry or the base web being coated is thin, the probability of web breaks becomes higher and breaks may occur even during the normal run.

SUMMARY OF THE INVENTION

Accordingly, it is an object of the present invention to provide an assembly capable of performing the roll change in off-machine equipment in a more reliable manner and at higher speed than is possible with conventional means.

A further object of the present invention is to provide an assembly capable of handling webs with a higher initial moisture content than previously conventional in unwinding with off-machine equipment.

The present invention is based on supporting the first web paid off from the first, expiring roll by means of a support felt while the web of the expiring roll is spliced to the web of the second, full new roll by pressing the web of the first roll backed by the support felt against the perimeter of the second roll by means of a splicing roll.

More specifically, the support felt passes as an endless loop over a plurality of rolls. At least one of the rolls is a transferrable roll that cooperates with the web received from the expiring web roll so that the web travels on the support felt. The roll is movable toward the new web roll to press the web from the expiring roll via the felt against the surface of the new web roll. Significant benefits are offered by the present invention.

The principal benefit of the present invention is the reduction of web breaks during a roll change. The duration of a finishing line shutdown is clearly reduced due to the lower number of web breaks. Roll changes can be made at a higher speed than is conventional, and, even at the maximum web speed of the finishing line, thus permitting the line to continuously operate at maximum efficiency. Since the initial moisture content of the web can be increased, the probability of web breaks can be reduced, because a base sheet of higher moisture content is less susceptible to web breaks during a disturbance than a dry base sheet. The proportion of sulfate fibers in the base sheet can be reduced, whereby the price of the base sheet becomes lower and its opacity can be improved. The basis weight of the base sheet can be reduced, in other words, a thinner base sheet can be used, whereby a higher coat weight can be used in a finished grade of the same final weight. The higher coat weight in turn provides improved printing properties.

The various features of novelty which characterize the present invention are pointed out with particularity in the claims annexed to and forming a part of the disclosure. For a better understanding of the present invention, its operating advantages, and specific object attained by its use, reference should be had to the drawings and descriptive matter in which there are illustrated and described preferred embodiments of the present invention.

BRIEF DESCRIPTION OF THE DRAWINGS

In the drawings, wherein like reference numerals delineate similar elements throughout the several views:.

DETAILED DESCRIPTION OF THE PREFERRED EMBODIMENTS

Figure 1:
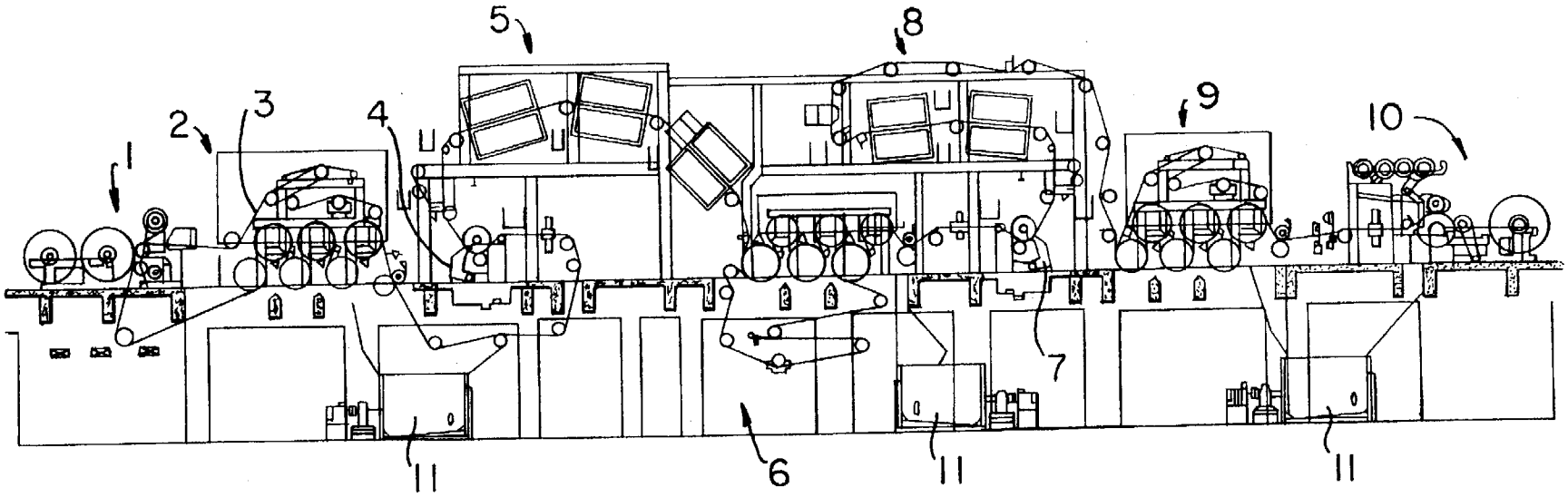
FIG. 1 is a general layout of an off-machine coating line in which the unwinder is provided with an assembly according to the present invention.

With reference to FIG. 1, a coating line is shown incorporating two coater stations 4, 7. The first unit in the line is an unwinder 1. From the unwinder 1 the web being finished is supported by a felt 3 and passes downstream to a first dryer cylinder group 2. On the dryer cylinder 2 the damp web is dried to a suitable moisture content for applying the coat. Subsequent to drying, the web is routed to a first coater station. After coating, the web of now higher moisture content and the coat are dried with dryers 5. The layout of FIG. 1 has first a set of three dryers, followed by a second dryer cylinder group 6 comprising three steam cylinders and three vacuum, or VAC, cylinders. The web is passed through the dryer cylinder group 6 supported by a felt. Following or downstream of the second dryer cylinder group 6 is a second coater station 7, two dryers 8 and a third dryer cylinder group 9 comprising VAC and steam cylinders. At the exit of the web from the third dryer cylinder group 9, the web is rewound into a roll by a rewinder 10. To handle the broke, the configuration can be complemented with three pulpers 11. The pulpers 11 are placed under the framework, to the outgoing side end of the dryer cylinder groups 2, 6, 9. At the occurrence of a web break or other disturbance, the web is cut after the dryer cylinder group with the edge trimmer, and the broke is guided to the pulper 11 for recycling. The edge strip travelling along with the web edge is guided through the line in a rope nip formed by rope carriers. After the disturbance is rectified, the knife of the edge trimmer is moved obliquely over the web, whereby the web can assume its normal width.

The above-described configuration represents only an exemplifying embodiment of a modern paper web finishing line adapted to incorporate an assembly according to the present invention. Obviously, the number and type of coater stations, dryers and other equipment of the line are selected according to the specific requirements of each paper mill and grades manufactured.

Figure 2:
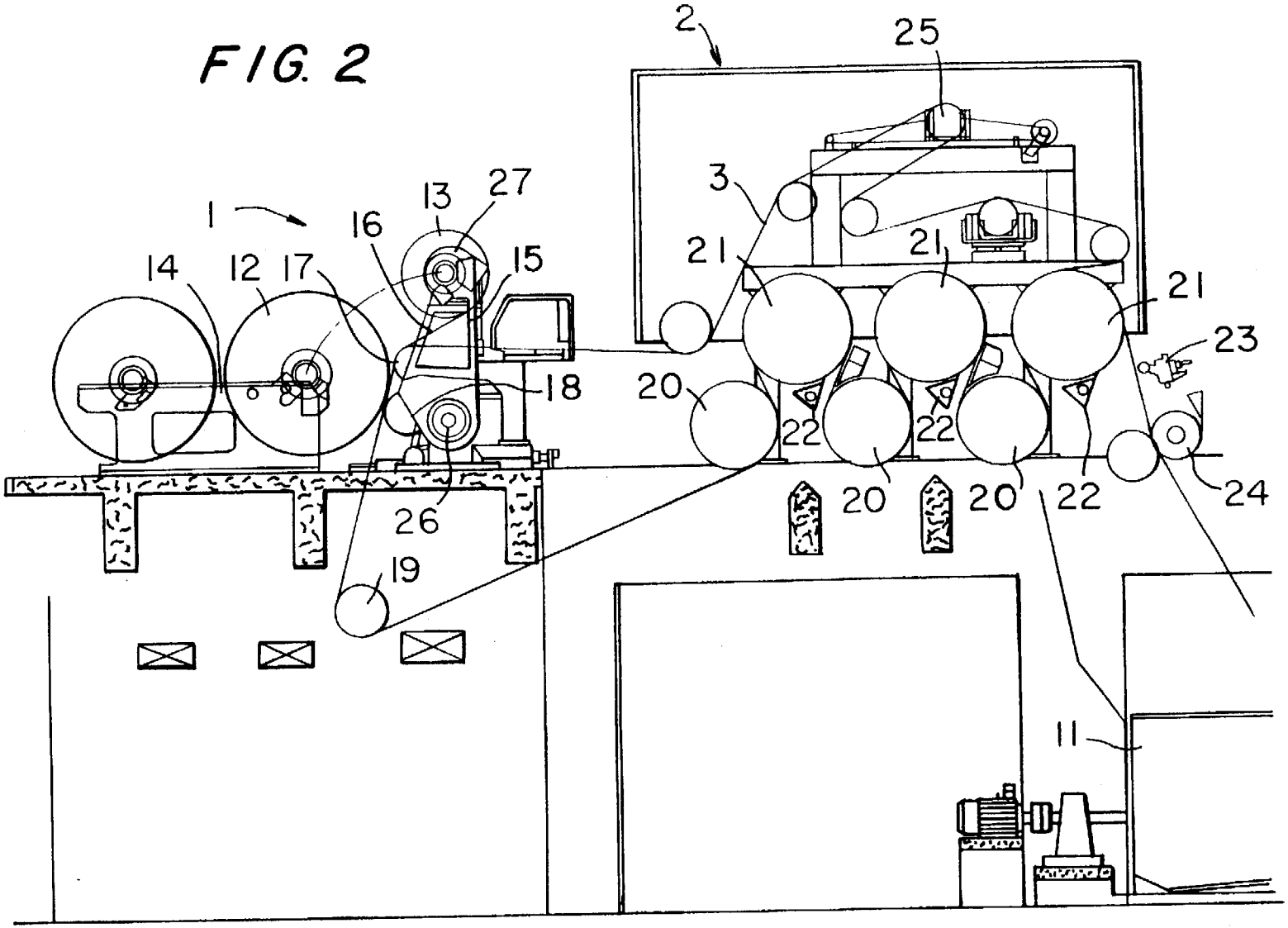
FIG. 2 is a detail of the diagram of FIG. 1.

With reference to FIG. 2, the unwinder 1 with associated dryer cylinder unit 2 is shown in greater detail. The unwinder 1 comprises a framework 14 carrying on its upper surface roll feed rails ending at the actual unwinder station, herein referred to as the primary unwinder station. The primary unwinder station is shown in the diagram carrying a second full roll a new roll 12. At the side of the framework 14 are situated transfer arms 15 of the secondary unwinder having the expiring first roll 13 held by chucks 27 at one end of the arms. The aims 15 are connected at their other ends to the frame part of the arm assembly by means of a pivoting joint 26. To the right side of the unwinder 1 is located the dryer cylinder group 2 comprising three vacuum, or VAC, cylinders 20 and three steam cylinders 21 The web passes through the dryer cylinder group guided by a support felt 3.

The path of the support felt 3 in the system is as follows. In the secondary unit of the unwinder 1 there is a first guide roll 17 and a splicing roll 18. The felt 3 first passes the guide roll 17, where its direction is diverted to run downward, parallel with the web 16 received from the roll 13. Under the unwinder 1 is located another guide roll 19 which acts to divert the felt toward the dryer cylinder group 2. This dryer cylinder group 2 has a VAC roll 20 as the first cylinder. The structure of the VAC roll is such that it permits a vacuum to be applied to its inside, and as the roll surface is either porous or has a plurality of small holes, the vacuum sucks the felt 3 running on the roll 20 and the web 16 ruining on the felt to adhere to the roll. The purpose of the VAC roll is to assure the adherence of the web to the felt 3, and a further purpose of the vacuum is to assure that the felt 3 travels smoothly rotated by the cylinder group 2 instead of excessively slipping on the rolls.

Downstream from the VAC cylinder 20 the felt 3 and the web pass to a steam cylinder 21. On the steam cylinder 21 the web 16 is in intimate or direct contact with the surface of the cylinder 21 pressed by the felt 3. Thus, an effective transfer of heat from the hot cylinder 21 to the web is attained, whereby the web is dried with the applied heat. Next, the felt and the web pass to the next VAC roll 20, a steam cylinder 21, and then once more to another VAC roll 20 and a steam cylinder 21. Adapted to the free sector of the steam cylinders 21, which in this case remains below the cylinders, are cleaning doctor blades 22 acting to remove coat debris possibly adhering to the surfaces of the steam cylinders 21.

The web 16 is separated from the felt 3 downstream of or after the last steam cylinder 21. The felt 3 is routed back via guide rolls to above the cylinder group onto a tension roll 25 from which the felt passes to the first guide roll 17, and the felt path thus forms an endless loop. The web in turn is drawn from the steam cylinder 21 via a draw nip 24 to a first coater station 4, show in FIG. 1. The draw nip 24 is required in this embodiment, because a disturbance-free detachment of the web from the felt is desired and the distance of the first coater station 4 from the dryer cylinder group 2 is large. Moreover, the draw roll nip 24 serves to maintain constant web tension. Between the last steam cylinder 21 and the draw roll nip 24 is located a web edge trimmer 23, which in the event of a web break cuts the web, which then passes into a pulper 11.

Figure 3:
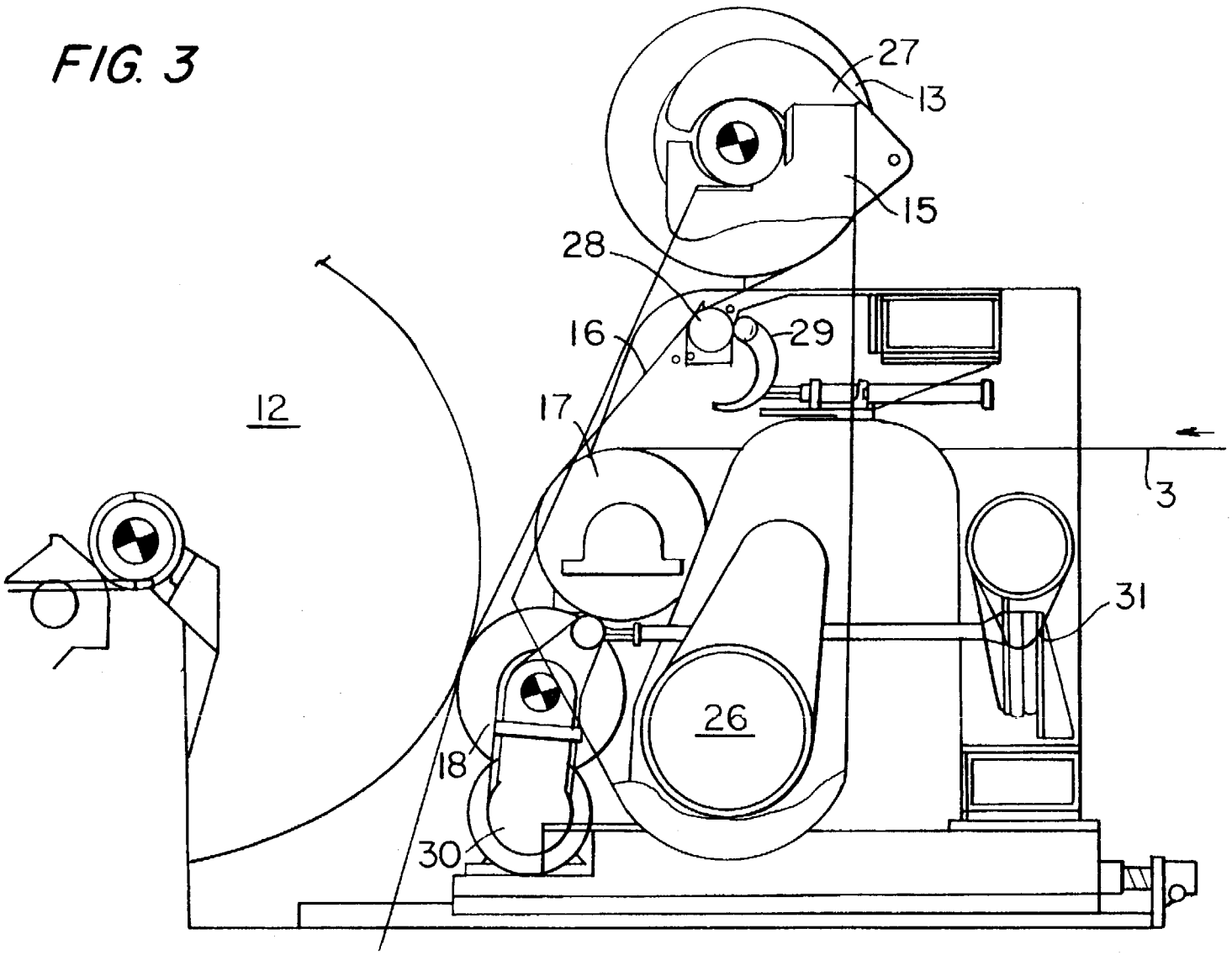
FIG. 3 is a detail of the diagrams of FIGS. 1 and 2.

With reference to FIG. 3, the unwinder 1 and its elements associated with the roll change are shown. It must be noted herein that due to the drafting scale used, not all details shown in FIG. 3 can be found in FIGS. 1 and 2. At one end of the transfer arms 15 chucks 27 are mounted to which the expiring roll 13 is clamped for the duration of the roll change. As noted above, the support felt 3 passes to the unwinder 1 and is then diverted by means of a guide roll 17 to ran parallel with the web 16 paid off from the expiring roll 13. Next on the path of the felt loop 3 is adapted a splicing roll 18. The splicing roll 18 is mounted supported by a pivoting arm 30 and thus the roll 18 is movable by means of an air bellows 31, which is connected by a link rod to the pivoting arm 30. With reference to FIG. 3, the splicing roll 18 is shown in the position used for splicing the web of the new roll 12 to the web 16 of the expiring roll. Besides these elements, the unwinder 1 further includes a cutting knife 29. The cutting knife 29 is adapted above the support felt 3 passing to the guide roll 17 so that the cutting point of the web 16 falls within that web length which remains between the roll 13 already transferred to the secondary stand and the first guide roll 17. In parallel with the cutting knife 29 is adapted a support roll 28 which tensions the web 16 paid off from the roll 13 in the secondary stand so that the web can be easily cut by a swing of the curved cutting knife 29.

In the above-described system the handling of the paper rolls and the web occurs as follows.

With reference to FIG. 2, the expiring roll 13 is shown lifted with the help of the transfer arms 15 to the secondary roll unwinder stand and the following, new roll 12 is already lifted in the roll stand of the primary unwinder. According to this diagram, the roll 12 in the primary unwinder is shown still rotating freely. Two-sided splicing tapes are placed on the surface of the roll 12 in the primary unwinder and the roll speed is already accelerated to the speed of the web 16 being unwound from the roll 13 resting on the secondary unwinding stand. The web being paid off from the secondary unwinding stand meets the support felt 3 at the first guide roll 17 and travels thereafter supported by the felt 3. When the roll 13 in the secondary unwinder stand has been paid off to a sufficiently small diameter and the web speed of the roll resting in the primary unwind stand has been accelerated sufficiently high, the web 16 of the roll 13 is spliced to the outer surface of the roll 12 by means of the two-sided splicing tape. The splicing takes place so that the edge position of the tape is detected with the help of, e.g., a photocell which gives the air bellows or actuator 31 of the splicing roll 18 a signal to press the web 16 received from the secondary unwinder via the felt 3 onto the surface of the roll 12 rotating in the primary unwind stand. Immediately after the webs are adhered together, the curved cutting knife 29 severs the web 16 received from the secondary unwinder by a rapid swing from behind the support roll 28 onto the web 16. Subsequently, the web begins to be paid off from the new roll 12 in the primary unwinder.

Web breaks during the above-described process account for the majority of web breaks that occur in coating lines. The principal reason for the web breaks has been the large difference in web tension between the running web 16 and the spliced web paid off from the roll 12 starting to rotate in the primary unwinder, whereby a tearing jolt has been imposed on the new web as the web is tensioned after splicing. Here, in contrast, the new web runs according to the present invention supported by the felt 3, whereby any excessively rapid tensioning of the web is avoided, since the web is travelling with the felt 3 and the speed of the felt 3 does not change during the splicing or after it. The adherence of the web to the felt 3 is assured in the preferred, above-described embodiment by means of VAC cylinders 20 which adhere the web by suction to the support felt 3. By virtue of the support felt 3, the incidence of web breaks can be reduced to such a low rate that the roll change can be made at full web speed if so desired.

When the roll 12 in the primary unwinder is being unwound, the roll diameter becomes smaller and the support felt with its guide roll 17 and splicing roll 18 must be transferred closer to the roll 12 in order to prevent the web being paid off from the roll 12 from detaching from the support felt 3. To facilitate this transfer, the felt 3 is provided with a tension roll 25 to tension or slacken the felt 3. The movement of the tension roll 25 can also accommodate the tension change caused by the action of the splicing roll 18 on the felt 3.

When the diameter of the roll 12 in the primary unwind stand is reduced to a preset minimum, the roll is lifted by means of the transfer arms 15 to the secondary unwind stand and the first guide roll 17 and the splicing roll 18 are moved sufficiently backward that the next new roll can be received into the primary unwinder. The next roll change is then effected again in the above-described manner.

One important aspect of the present invention is the draw roll nip 24. This nip assembly comprises two rolls, of which one is the draw roll and the other is a backing roll, and a doctor blade. The draw roll nip 24 is located in the above-described embodiment after the dryer cylinder group 2, and its position in the machine direction is invariably located so that the nip is after the point where the web is detached from the support felt 3 but before the first coater station 4.

Between the draw roll nip 24 and the detachment point of the web from the felt 3 is placed an edge trimmer 23. The draw roll nip 24 and the edge trimmer 23 perform several functions in the assembly. As the web is received from the unwinder 1 travelling on the support felt 3, it does not attain its normal web tension in the same manner as a web drawn unsupportedly in the conventional manner by means of draw rolls directly from a roll in a stand. Therefore, the web tension is advantageously controlled by means of the draw nip to make the web enter the subsequent process stages correctly tensioned. Further, the draw roll nip 24 assures that the web is positively detached from the support felt 3. The edge trimmer 23 serves the purpose of cutting the web if a disturbance should occur on the coating line. The web is cut by transferring the trimmer knife obliquely across the web close to the other edge of the web and stopping the knife there before the web is entirely cut. In this marginal position the knife separates a narrow edge strip from the web that is then threaded forward in the line in a rope carrier nip. During this time, a major part of the web is routed to a pulper 11 and the winding of the web tail about the draw roll is prevented by virtue of the doctor blade. As soon as the disturbance is rectified, the knife of the edge trimmer 23 is moved back to its home edge, whereby the web assumes its full width threaded with the help of the rope carrier nip. In this manner, a rapid tail feed after web breaks is attained and the down times due to web breaks and other disturbances remains shorter.

Besides those described above, the present invention can have alternative embodiments.

In its simplest form the present invention comprises only the support felt 3, the first guide roll 17, the splicing roll 18, elements 25 for tensioning the felt and guide rolls for guiding the path of the felt 3. In principle, even the first guide roll can be omitted as the felt can be directly routed to the splicing roll 18. In this case, the web need be taken without the help of the draw roll nip to the first coater station or other finishing equipment. Such an assembly would find applications in feeding the web directly from an unwinder to some kind of a calender, whereby the calender provides the draw nip capable of detaching the web from the felt 3. In practice, the equipment most typically comprises the draw roll nip 24 and at least one cylinder pair capable of assuring the adherence of the web to the felt. Such cylinders are advantageously VAC cylinders and dryer cylinders., whereby the drying of the web can be performed prior to the entry of the web into a coater station or similar equipment. The number and type of the cylinders are selected according to the required drying capacity and mechanical construction. Obviously, many multiple different embodiments are possible for the guiding, tensioning and mechanical construction of the assembly.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. An assembly for a web finishing line for unwinding web rolls and for splicing of a first web paid off from an expiring first web roll to a second web rolled on a second web roll while substantially maintaining a speed of web paid off by the assembly during splicing, comprising:

a finishing means for finishing a web including an endless support felt upon which the web is supported as it travels at least partially through said finishing means;

a continuously operating unwinding means for unwinding the expiring first web roll and the second web roll;

an applying means for applying the web paid off from the first web roll to said support felt at an application point;

a splicing roll for splicing the first web paid off from the first web roll downstream of the application point to an end portion of the second web of the second web roll, said splicing roll being movable toward the second web roll to press the support felt and the first web paid off from the first web roll against the second web paid off from the second web roll;

a cutting means for cutting the first web of the first web roll upstream of the application point, the web unwound by said unwinding means being fed into said finishing means from said applying means supported by said endless felt; and a tension roll for adjusting tension in said support felt upstream of the application point to compensate for changes in web tension upon splicing of the first web to the second web;

wherein the first and second web rolls, the support felt, the applying means and the splicing roll are positioned and operable so that, prior to cutting the first web during splicing, said support felt supports the first web paid off from the first web roll and the second web paid off from the second web roll downstream of the application point.

2. The assembly of claim 1, wherein said applying means comprises a guide roll.

3. The assembly of claim 2, wherein said finishing means further comprises a vacuum cylinder.

4. The assembly of claim 2, wherein said finishing means further comprises a heatable dryer cylinder.

5. The assembly of claim 1, wherein said finishing means further comprises a vacuum cylinder.

6. The assembly of claim 1, wherein said finishing means further comprises a means for detaching the web from the support felt prior to leaving said finishing means, and a draw roll nip to adjust the tension in the web, said draw roll nip being downstream of said web detaching means.

7. The assembly of claim 6, wherein said finishing means further comprises an edge trimmer positioned downstream of said web detaching means and upstream of said draw roll nip, said edge trimmer operable to trim an edge of the web.

8. An unwinding assembly for unwinding web rolls and for splicing of a first web paid off from an expiring first web roll to a second web rolled on a second web roll while substantially maintaining a speed of web paid off by the unwinding assembly during splicing, comprising:

a first unwinder for unwinding the first web from the first web roll;

a second unwinder for unwinding the second web from the second web roll;

a support felt;

a guide roll over which said support felt travels, said guide roll being disposed so that the first web paid off from the first web roll on said first unwinder is applied to said support felt at an application point so that the first web is supported by said support felt downstream of the application point;

a splicing means for causing an end portion of the second web of the second web roll on said second unwinder to contact the first web supported by said support felt to enable splicing of the second web to the first web;

a cutting means for cutting the first web paid off from the first web roll, the cutting means positioned to cut the first web upstream of the application point;

a tension roll for adjusting tension in said support felt upstream of the application point to compensate for changes in web tension upon splicing of the first web to the second web;

wherein the first and second web rolls, the support felt, the guide roll and the splicing means are positioned and operable so that, prior to cutting the first web during splicing, said support felt supports the first web paid off from the first web roll and the second web paid off from the second web roll downstream of the application point.

9. The unwinding assembly of claim 8, wherein said splicing means comprises a splicing roll movable between a first position and a second position such that when said splicing roll is in said first position, said splicing roll presses the support felt to cause the first web to contact the second web and such that when said splicing roll is in said second position, the first web is spaced a distance from the second web.

10. The unwinding assembly of claim 8 combination with a finishing apparatus for finishing the web paid off by the unwinding assembly, the web paid off by the unwinding assembly being fed into said finishing apparatus supported by said support felt.

* * * * *